US006520497B2

(12) United States Patent
Tamura

(10) Patent No.: US 6,520,497 B2
(45) Date of Patent: Feb. 18, 2003

(54) SHEET FEEDING APPARATUS, AND IMAGE FORMING APPARATUS AND IMAGE READING APPARATUS PROVIDED WITH THE SAME

(75) Inventor: Masashige Tamura, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 09/771,981

(22) Filed: Jan. 30, 2001

(65) Prior Publication Data

US 2001/0024011 A1 Sep. 27, 2001

(30) Foreign Application Priority Data

Feb. 4, 2000 (JP) ..... 2000-028293

(51) Int. Cl.[7] ..... B65H 3/52
(52) U.S. Cl. ..... 271/122
(58) Field of Search ..... 271/122

(56) References Cited

U.S. PATENT DOCUMENTS 4,451,027 A * 5/1984 Alper ..... 198/461.1
4,627,607 A * 12/1986 Ishii ..... 271/122
6,332,608 B1 * 12/2001 Tamura ..... 271/10.13

FOREIGN PATENT DOCUMENTS

JP 3-172249 * 7/1991

* cited by examiner

*Primary Examiner*—Donald P. Walsh
*Assistant Examiner*—Kenneth W Bower
(74) *Attorney, Agent, or Firm*—Fitzpatrick, Cella, Harper & Scinto

(57) ABSTRACT

The present invention provides a sheet feeding apparatus for separating and feeding sheets contained in sheet containing means one by one that has separating and feeding means including a feeding rotary member and a separating rotary member brought into pressure contact with the feeding rotary member and a torque limiter provided between the separating rotary member and a driving shaft wherein a coefficient of friction of the separating rotary member is set so that relations that $\mu_{BC}$ N>T/r, $\mu_{BP}>\mu_{CP}$, and T/r>$\mu_{CP}$ N>$\mu_{PP}$ N may be established among a coefficient of friction $\mu_{BC}$ between the feeding rotary member and the separating rotary member, a coefficient of friction $\mu_{BP}$ between the feeding rotary member and the sheet, a coefficient of friction $\mu_{CP}$ between the separating rotary member and the sheet, a coefficient of friction $\mu_{PP}$ between the sheets, a pressure contact force N of the separating rotary member, an idling torque T of the torque limiter and an effective radius r of the separating rotary member.

10 Claims, 12 Drawing Sheets

SHEET FEEDING APPARATUS, AND IMAGE FORMING APPARATUS AND IMAGE READING APPARATUS PROVIDED WITH THE SAME

BACKGROUND OF THE INVENTION

1. Field of the Invention

This invention relates to a sheet feeding apparatus for feeding sheets, and an image forming apparatus and an image reading apparatus provided with the same, and particularly to such apparatuses provided with separating and feeding means adapted to separate and feed sheets one by one by the use of a retard separating method.

2. Related Background Art

An image forming apparatus or an image reading apparatus according to the prior art is provided with a sheet feeding apparatus for conveying recording sheets to an image forming portion or an original to an image reading portion. FIG. 6 of the accompanying drawings shows the construction of such a sheet feeding apparatus according to the prior art, and in FIG. 6, the reference numeral 1 designates a sheet feeding apparatus for supplying recording sheets 2 to an image forming portion, not shown.

This sheet feeding apparatus 1 is provided with a pickup roller 5 for feeding out the uppermost recording sheet 2*a* of recording sheets 2 stacked on a stacking plate, not shown, provided on a sheet containing device 3, a feed roller 6 for conveying the recording sheet 2*a* fed by the pickup roller 5 to an image forming portion, a retard roller 7 brought into pressure contact with the feed roller 6 and rotated in the same direction as or the opposite direction to the direction of rotation of the feed roller 6, and a pair of conveying rollers 9 provided downstream of the feed roller 6.

A first guide 10 is disposed between the pickup roller 5 and the combination of the feed roller 6 and the retard roller 7, a second guide 11 is disposed between the combination of the feed roller 6 and the retard roller 7 and the pair of conveying rollers 9, and further a third guide 12 is disposed downstream of the pair of conveying rollers 9, and the recording sheets 2 may be guided and conveyed by these guides 10 to 12.

Here, the retard roller 7 which is a separating rotary member cooperates with the feed roller 6 which is a feeding rotary member to constitute separating and feeding means for separating and feeding the recording sheets 2 fed out by the pickup roller 5 which is sheet feeding means one by one, and when a plurality of recording sheets 2 are fed from the sheet containing device 3, the retard roller 7 is adapted to be rotated in the opposite direction to the direction of rotation of the feed roller 6, as shown in FIG. 6, to thereby separate the uppermost recording sheet 2*a* from the other recording sheets 2.

On the other hand, FIG. 7 of the accompanying drawings shows the construction of a drive transmitting device for driving the feed roller 6 and the retard roller 7, and in FIG. 7, the reference numeral 13 denotes the drive transmitting device. This drive transmitting device 13 is provided with a feed roller shaft 15 on which the feed roller 6 is mounted, a retard roller shaft 16 on which the retard roller 7 is mounted, and a retard roller driving shaft 17 which is a driving shaft connected to the retard roller shaft 16. The retard roller shaft 16 and the retard roller driving shaft 17 are provided substantially in parallelism to the feed roller shaft 15 and supported by a pivotally movable supporting member, not shown, and movable toward and away from the feed roller shaft 15.

Also, the reference numeral 20 designates a torque limiter provided between the retard roller shaft 16 and the retard roller driving shaft 17, and the reference numeral 22 denotes an electromagnetic clutch provided on the end portion of the feed roller shaft 15 for transmitting a driving force transmitted from the main driving means of the main body of an image forming apparatus, not shown, through a driving input belt 21 to the feed roller shaft 15.

Also, the reference numeral 23 designates a retard driving belt extended between the feed roller shaft 15 and the retard roller driving shaft 17 for transmitting a rotatively driving force transmitted to the feed roller shaft 15 further to the retard roller driving shaft 17. The reference numeral 19 denotes a coupling provided between the retard roller shaft 16 and the retard roller driving shaft 17 for transmitting the drive of the retard roller driving shaft 17 to the retard roller shaft 16.

Description will now be made of the driving of the feed roller 6 and retard roller 7 by the drive transmitting device 13 constructed as described above.

When a rotatively driving force is given from the main driving means, this rotatively driving force is inputted through the driving input belt 21 a pulley 25 provided on the armature portion, not shown, of the electromagnetic clutch 22 ON-OFF-controlled in conformity with sheet feed timing. Here, the feed roller shaft 15 is adapted to rotate with the rotor portion, not shown, of the electromagnetic clutch 22, and the feed roller shaft 15 and the retard roller driving shaft 17 and the retard roller shaft 16 are connected together by the retard driving belt 23.

Thus, when the feed roller 15 is rotated, the retard roller driving shaft 17 is rotated in the same direction as the feed roller shaft 15, and further, when the feed roller 15 and the retard roller driving shaft 17 are thus rotated, the feed roller 6 and the retard roller 7 are rotatively driven in synchronism with the ON of the sheet feed timing.

Now, when the recording sheets 2 are fed one by one in the direction of arrow b in FIG. 6, the frictional force between the feed roller 6 and the recording sheet 2 acting on the retard roller 7 is greater than the returning force of the torque limiter 20 and therefore, the retard roller 7 and the retard roller shaft 16 are adapted to be driven to be rotated in the opposite direction to the rotatively driving direction of the retard roller driving shaft 17 while idly rotating the torque limiter 20.

Also, when a plurality of recording sheets 2 are fed, the frictional force among the plurality of recording sheets 2 is small relative to the frictional force between the retard roller 7 and the recording sheet 2 and therefore, the torque limiter 20 is not idly rotated, whereby the retard roller 7 and the retard roller shaft 16 are rotated in the same direction as the rotatively driving direction of the retard roller driving shaft 17.

By the retard roller 7 being rotated in such a direction, of the plurality of recording sheets 2 fed, the recording sheet 2*a* which is most adjacent to the feed roller 6, that is, which is uppermost, comes to be separated from the other recording sheets 2, whereby the plurality of recording sheets 2 can be prevented from being conveyed to the image forming portion. Hereinafter, the phenomenon that a plurality of recording sheets 2 are fed from the sheet containing device 3 to the retard roller 7 will be referred to as "bundle conveyance", and the phenomenon that the plurality of recording sheets 2 cannot be separated from one another and are fed will be referred to as "double feeding".

Description will now be made of theoretical expressions satisfying the feeding and separating conditions for the recording sheet 2 by such a sheet feeding apparatus 1.

Here, when the coefficient of friction between the feed roller 6 and the recording sheet 2 is defined as $\mu_{BP}$ and the coefficient of friction between the retard roller 7 and the recording sheet 2 is defined as $\mu_{CP}$ and the coefficient of friction between the recording sheets is defined as $\mu_{PP}$ and the pressurizing force (pressure contact force) of the retard roller 7 is defined as N and the idling torque of the torque limiter 20 is defined as T and the effective radius of the retard roller 7 is defined as r and the returning force of the torque limiter 20 is defined as T/r, the feeding condition of the feed roller 6, the separating condition for the recording sheet 2 and the driven to be rotated condition of the retard roller 7 are expressed as follows:

| | | |
|---|---|---|
| Feeding condition: | $\mu_{BP}N > T/r$ | (1) |
| Separating condition: | $\mu_{PP}N < T/r$ | (2) |
| Driven to be rotated condition: | $\mu_{CP}N > T/r$ | (3) |

Also, when T/r·N is defined as $\mu_T$, the foregoing feeding condition, separating condition and driven to be rotated condition are expressed as follows:

| | | |
|---|---|---|
| Feeding condition: | $\mu_{BP} > \mu_T$ | (4) |
| Separating condition: | $\mu_{PP} < \mu_T$ | (5) |
| Driven to be rotated condition: | $\mu_{CP} > \mu_T$ | (6) |

Now, FIG. 8 of the accompanying drawings is a graph showing the relations among the foregoing expressions (4), (5) and (6) with the pressurizing force N of the retard roller 7 and the idling torque T of the torque limiter 20 as parameters, and in FIG. 8, the hatched portion is a feeding area.

Here, to enlarge the hatched area, it is necessary to make the coefficients of friction between the respective rollers 6, 7 and the recording sheet great, and it can be understood from this figure that the feeding area will become wider if the feeding condition is set under a condition in a direction (rightwardly upward direction) in which both of the pressurizing force N of the retard roller 7 and the idling torque T of the torque limiter 20 are made great.

However, it is often the case that among recording sheets 2 usually used, the coefficient of friction between the sheets is irregular even if the sheets are of the same kind and depending on the user, recording sheets of different kinds are irregularly stacked on the stacking plate of the sheet containing device 3.

In such a case, if as shown, for example, in FIG. 9 of the accompanying drawings, the coefficient of friction between the lowermost recording sheet 2*b* of a bundle of recording sheets of a different kind and the recording sheet 2*c* just beneath it is remarkably small as compared with the coefficient of friction between the recording sheets near it, bundle conveyance occurs and the bundle-conveyed recording sheets 2 are conveyed to the nip portion N between the feed roller 6 and the retard roller 7, whereafter they are conveyed to the image forming portion while being separated. In FIG. 9, three recording sheets 2 are being bundle-conveyed.

However, when the recording sheets 2 are thus bundle-conveyed, even if the setting of the aforementioned feeding conditions (1) and (4) is changed, sometimes the bundle-conveyed recording sheets 2 cannot be separated and double feeding may occur.

This phenomenon will now be described with reference to a typical view of a bundle conveyance time shown in FIG. 10 of the accompanying drawings (FIG. 10 shows the conveyance of a bundle of three sheets).

Here, if the coefficients of friction $\mu_{PP}$ among the recording sheets 2 are all equal or the coefficient of friction $\mu_{BP1}$ between recording sheet No. 1 and recording sheet No. 2 is $\mu_{BP1}<\mu_{BP2}$ relative to the coefficient of friction between recording sheet No. 2 and recording sheet No. 3, the bundle-conveyed recording sheets will be separated in the order of recording sheet No. 3 and recording sheet No. 2 by the retard roller 7 and double feeding will not occur.

However, when the state that $\mu_{BP1}>\mu_{BP2}$ occurs, during the time until recording sheet No. 3 is separated by the retard roller 7 and passes through the nip portion N between the retard roller 7 and the feed roller 6, recording sheet No. 2 is dragged by recording sheet No. 1 and is fed by a predetermined distance toward the image forming portion. When recording sheet No. 2 cuts in between the pair of conveying rollers 9 before recording sheet No. 3 is completely separated, double feeding occurs as the result.

The behavior of the recording sheet (in FIG. 10, recording sheet No. 2) between the thus bundle-conveyed uppermost and lowermost recording sheets is determined by the coefficient of friction between the bundle-conveyed recording sheets 2 however parameters which are to determine the feeding condition, such as the pressurizing force of the retard roller 7, idling torque of the torque limiter 20 and the coefficient of friction between each roller and the recording sheet, may be varied.

The typical view of the bundle conveyance shown in FIG. 10 shows the conveyance of three sheets, but under the situation in which as in recent years, the kind of recording sheets is diversified the bundle conveyance of fine to ten sheets is not rare and of course, it makes the situation of separation more severe that the number of bundle-conveyed sheets increases.

Heretofore, to improve the separating performance in the feeding condition at any rate, for example, the idling torque of the torque limiter 20 has been made great and the pressurizing force of the retard roller 7 has been made small.

However, such a feeding condition is a feeding condition under which the wear of the retard roller 7 by the recording sheets 2 is liable to occur and therefore, the durability of the retard roller 7 is remarkably reduced. Further, the already described bundle conveyance occurs more remarkably in a high-speed apparatus wherein the durability of parts is required, and the setting of such a feeding condition that the durability of the retard roller 7 is reduced becomes a countermeasure adverse to the directionality of product.

So, heretofore, the feed roller 6 has been formed of a rubber material such as EPDM, while the retard roller 7 has been of such structure as shown in FIG. 11 of the accompanying drawings, that is, structure in which a sponge base material 151 is provided on the surface of a core material 150 and further, a silicon coat layer 153 is secured to the surface of the sponge base material 151 by a urethane adhesive layer 152.

The reason why the silicon material is used as the outermost layer of the retard roller 7 is that it is good for the continuation of a high coefficient of friction $\mu$, and it is for the purpose of preventing the pluck, planing or the like of the surface of the sponge and improving the durability of the retard roller 7 that the urethane adhesive layer 152 is provided as the intermediate layer.

When as described above, a sponge roller having the silicon coat layer 153 is used as the retard roller 7, the hardness of the retard roller 7 is smaller than the hardness of the feed roller 6 and therefore, when the two rollers 6 and 7 are in pressure contact with each other, the shape of the nip therebetween becomes a shape depressed toward the retard roller 7 side.

Therefore, when a bundle of recording sheets are fed into this nip portion by the pickup roller 5, the leading ends of the recording sheets get out of position in the form of roofing tiles, whereby the leading end portions of all the fed recording sheets become capable of directly contacting with the retard roller 7. As the result, even various recording sheets differing in thickness and coefficient of friction from one another can be reliably separated and fed by the retard roller 7 and thus, an improvement in the stability of feeding of the recording sheets can be achieved.

However, when in a conventional sheet feeding apparatus provided with such a retard roller, in order to enhance the separating performance as already described, the idling torque of the torque limiter 20 is made great and the pressurizing force of the retard roller 7 is made small, the durability of the retard roller 7 is remarkably reduced.

The conveying incapable state said to be the so-called durable life of the roller will now be described on the basis of the situation of change in $\mu$ (coefficient of friction) on the feed roller 6 and retard roller 7 during the endurance thereof.

As the endurance of the feed roller 6 and retard roller 7 progresses, the aforementioned $\mu_{BP}$ (the coefficient of friction between the feed roller 6 and the recording sheet 2) and $\mu_{CP}$ (the coefficient of friction between the retard roller 7 and the recording sheet 2) change following the process as shown in FIG. 12 of the accompanying drawings. When as already described, use is made of the retard roller 7 formed of sponge and having the silicon coat layer 153 on the outermost layer, the initial $\mu_{BP}$ and $\mu_{CP}$ are both high and stable at 2 or greater, and the situation of reduction in $\mu$ during the endurance of the two rollers substantially likewise progresses at $\mu_{BP}$ $\mu_{CP}$.

When the endurance of the feed roller 6 and retard roller 7 further progresses, the aforementioned expression (3) soon comes to break (that is, expression (1) also breaks) and comes to be below a straight line indicated by $\mu_T$ (=T/r·N) in FIG. 12. This straight line is a line indicative of the boundary where the retard roller is driven to be rotated, that is, when the coefficient of friction $\mu_{CP}$ between the retard roller and the recording sheet 2 is above this straight line, the retard roller is driven to be rotated by the recording sheet 2 being conveyed, and when $\mu_{CP}$ is below this straight line, slip occurs between the retard roller and the recording sheet 2 and the retard roller 7 slips.

When as described above, $\mu_{BP}$ and $\mu_{CP}$ are below the straight line indicated by $\mu_T$ (=T/r·N), the retard roller 7 has come not to be driven to be rotated by the recording sheet 2 being conveyed, or the feed roller 6 has become incapable of conveying the recording sheet 2 and has thus met the end of its life.

Besides, when for example, particular paper containing a great deal of calcium carbonate therein is to be conveyed, both of $\mu_{BP}$ and $\mu_{CP}$ are severely reduced for a small number of passed sheets under the influence of paper powder produced during the conveyance, and come to be below $\mu_T$, and the feed roller has sometimes come to meet the end of its life within a short period.

SUMMARY OF THE INVENTION

So, the present invention has been made in view of such circumstances and has as its object to provide a sheet feeding apparatus which can achieve an improvement in the durability of separating and feeding means, and an image forming apparatus provided with the same.

The present invention provides a sheet feeding apparatus for separating and feeding sheets contained in sheet containing means one by one, the sheet feeding apparatus being provided with:

separating and feeding means for separating and feeding the sheets one by one, the separating and feeding means being provided with a feeding rotary member rotatable in a direction to feed the sheets, and a separating rotary member brought into pressure contact with the feeding rotary member and rotatable in a direction to return the sheets t the sheet containing means; and a torque limiter provided between the separating rotary member and a driving shaft for driving the separating rotary member, for transmitting the drive from the driving shaft to the separating rotary member, and idly rotated when predetermined rotational torque in a reverse direction is transmitted to the separating rotary member;

wherein the coefficient of friction of the separating rotary member is set so that the relatives that $$\mu_{BC}\ N > T/r$$

$$\mu_{BP} > \mu_{CP}$$

$$T/r > \mu_{CP}\ N > \mu_{PP}\ N$$

may be established among the coefficient of friction $\mu_{BC}$ between the feeding rotary member and the separating rotary member, the coefficient of friction $\mu_{BP}$ between the feeding rotary member and the sheet, the coefficient of friction $\mu_{CP}$ between the separating rotary member and the sheet, the coefficient of friction $\mu_{PP}$ between the sheets, the pressure contact force N of the separating rotary member, the idling torque T of the torque limiter and the effective radius r of the separating rotary member.

DESCRIPTION OF THE PREFERRED EMBODIMENTS

Some embodiments of the present invention will hereinafter be described with reference to the drawings.

Figure 1:
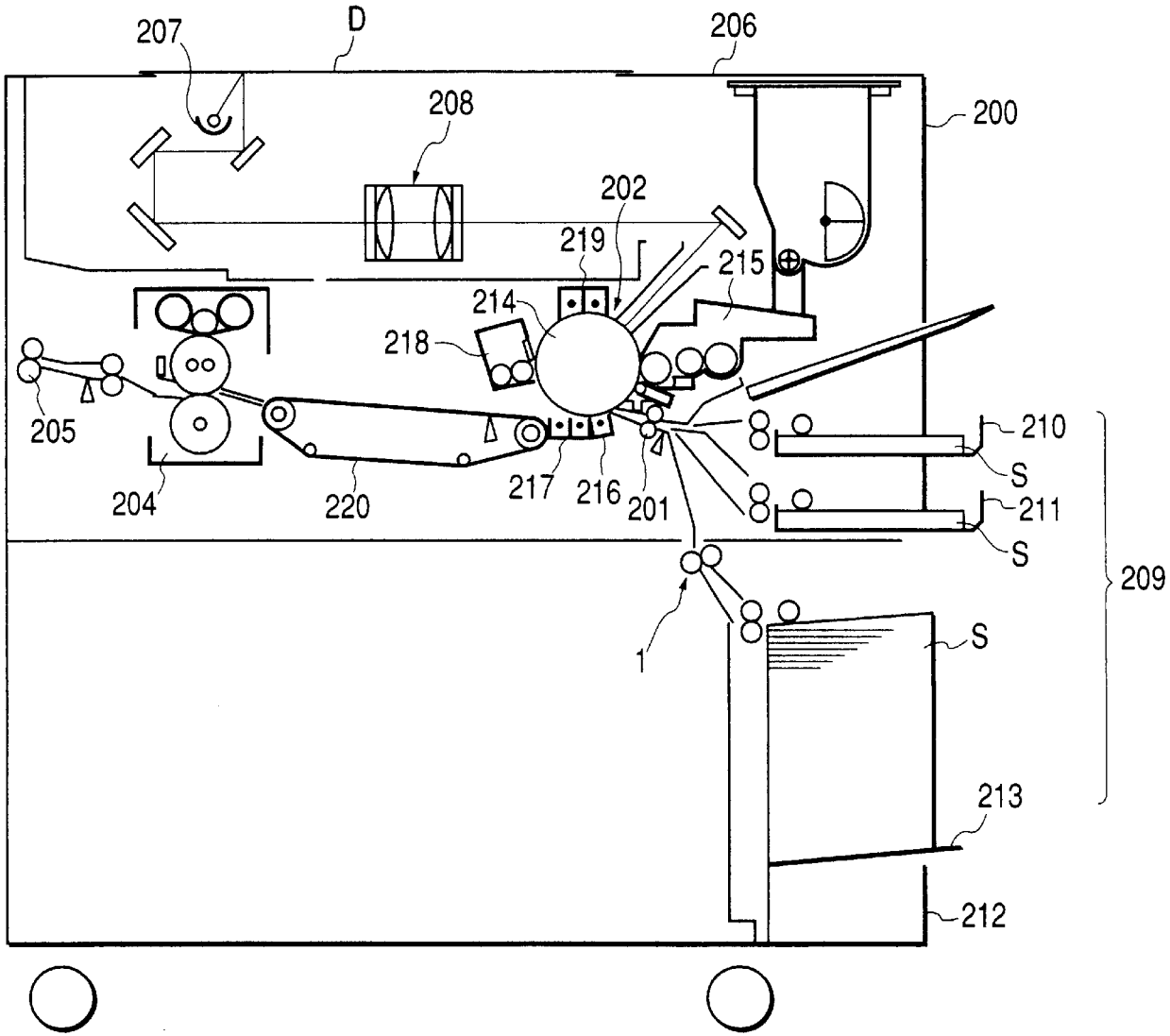
FIG. 1 shows the construction of an image forming apparatus provided with a sheet feeding apparatus according to a first embodiment of the present invention.

FIG. 1 shows the construction of an image forming apparatus provided with a sheet feeding apparatus according to a first embodiment of the present invention. In FIG. 1, the reference numeral 200 designates the main body of the apparatus, and the main body 200 of the apparatus is provided with an original supporting plate 206, a light source 207, a lens system 208, a sheet feeding portion 209, an image forming portion 202, etc.

The sheet feeding portion 209 is provided with cassettes 210, 211 containing recording sheets S therein and detachably attachable to the main body 200 of the apparatus and a paper deck 213 disposed on a pedestal 212, and a sheet feeding apparatus 1 for feeding the recording sheets S contained in these cassettes 210, 211 and the paper deck 213 to the image forming portion 202.

Also, the image forming portion 202 is provided with a cylindrical photosensitive drum 214, a developing device 215 containing a toner therein, a transferring charger 216, a separating charger 217, a cleaner 218 and a primary charger 219, and further a conveying apparatus 220, a fixing apparatus 204 and discharge rollers 205 are disposed downstream of the image forming portion 202.

The operation of this image forming apparatus will now be described.

When a sheet feeding signal is outputted from a control device, not shown, provided in the main body 200 of the apparatus, the sheet feeding apparatus 1 is operated and a recording sheet S is fed from the cassette 210 or 211 or the paper deck 213 toward the image forming portion 202.

Also, in parallel therewith, light is applied from the light source 207 toward an original D placed on the original supporting plate 206, and the light applied to and reflected from the original D is applied through the lens system 208 to the photosensitive drum 214 of which the surface is charged in advance by the primary charger 219. Thereby, an electrostatic latent image is formed on the surface of the photosensitive drum 214, and then a toner image is formed by the developing device 215.

The recording sheet S fed from the sheet feeding portion 209 has its skew feeding corrected by registration rollers 201 and is further fed to the image forming portion 202 is timed relationship with the image formation, whereupon in the image forming portion 202, the toner image on the photosensitive drum 214 is transferred by the transferring charger 216.

Thereafter, the recording sheet S to which the toner image has been transferred is charged to a polarity opposite to that of the transferring charger 216 by the separating charger 217 and is separated from the photosensitive drum 214, whereafter it is conveyed to the fixing apparatus 204 by a conveying apparatus 220, and the unfixed transferred image thereon is permanently fixed by the fixing apparatus 204. The recording sheet S on which the image has been fixed is discharged from the main body 200 of the apparatus by the discharge rollers 205. In this manner, an image is formed on the recording sheet S fed from the sheet feeding portion 209, and the recording sheet S is discharged.

Figure 2:
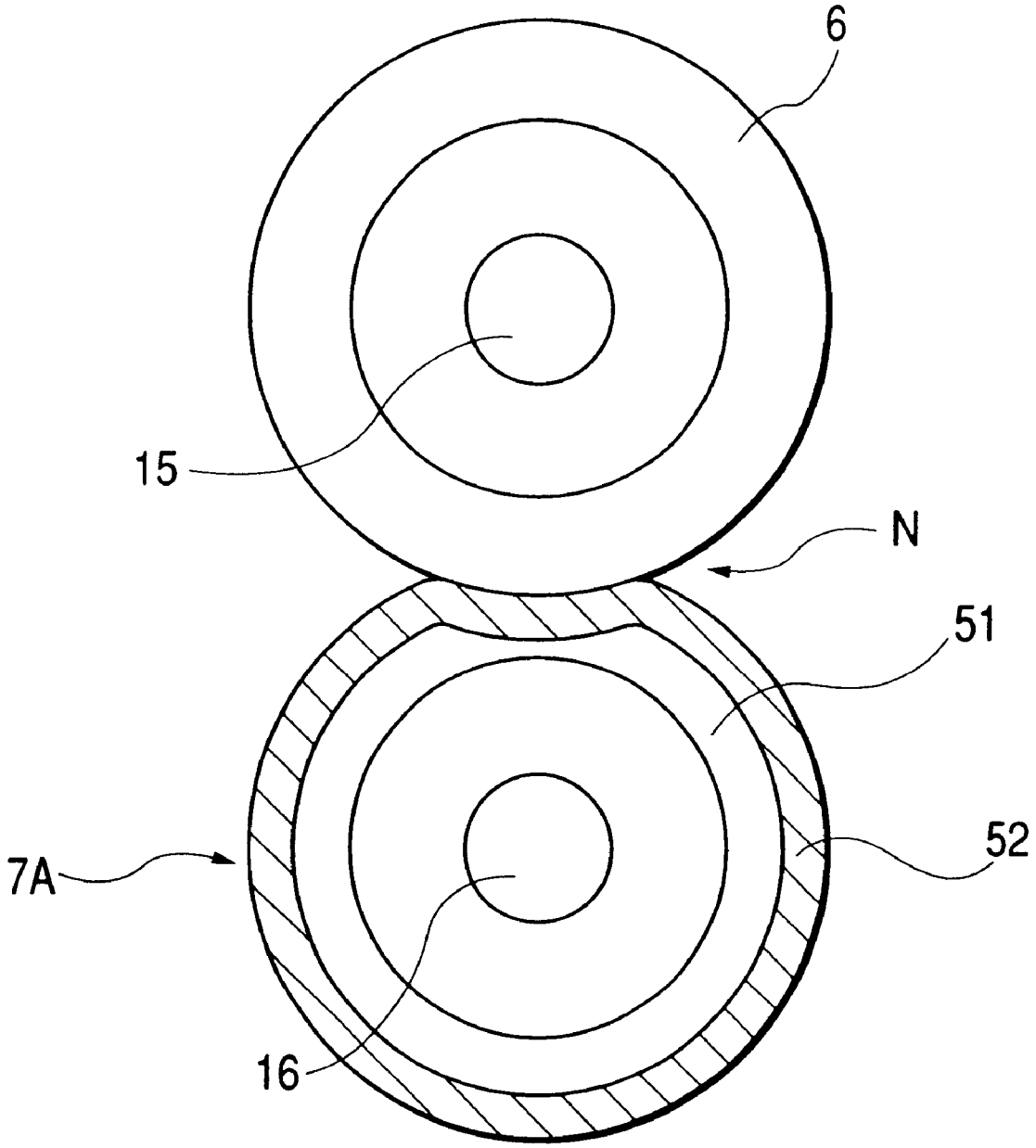
FIG. 2 illustrates the construction of the separating and feeding means of the sheet feeding apparatus.

Now, referring to FIG. 2 which shows the construction of the separating and feeding means of the sheet feeding apparatus 1, the reference character 7A designates a retard roller in pressure contact with a feed roller 6. This retard roller 7A is comprised of a sponge portion 51 which is a base material formed of polyurethane foam having asker C hardness of the order of 7°, and a coating portion 52 forming the outer peripheral surface of the retard roller and applied by uniformly spray-coating the same urethane liquid as the base material. It is for preventing the pluck, planing or the like of the surface of the sponge to thereby improve the durability of the retard roller 7A that the retard roller 7A which is such a sponge roller is provided with such a coating portion 52.

The nip portion N between this retard roller 7A and the feed roller 6 formed of EPDM rubber is formed into a concave shape by the feed roller 6 and the retard roller 7A being in pressure contact with each other and the feed roller 6 eating into the retard roller 7A, as shown in FIG. 2. By the nip portion N between the feed roller 6 and the retard roller 7A being thus formed into a concave shape, the recording sheets fed thereinto can be deviated from one another like roofing tiles, whereby the bundle-conveyed recording sheets continue to be reliably gripped by the nip portion N during the separating operation and thus, stable separation becomes possible.

Figure 3:
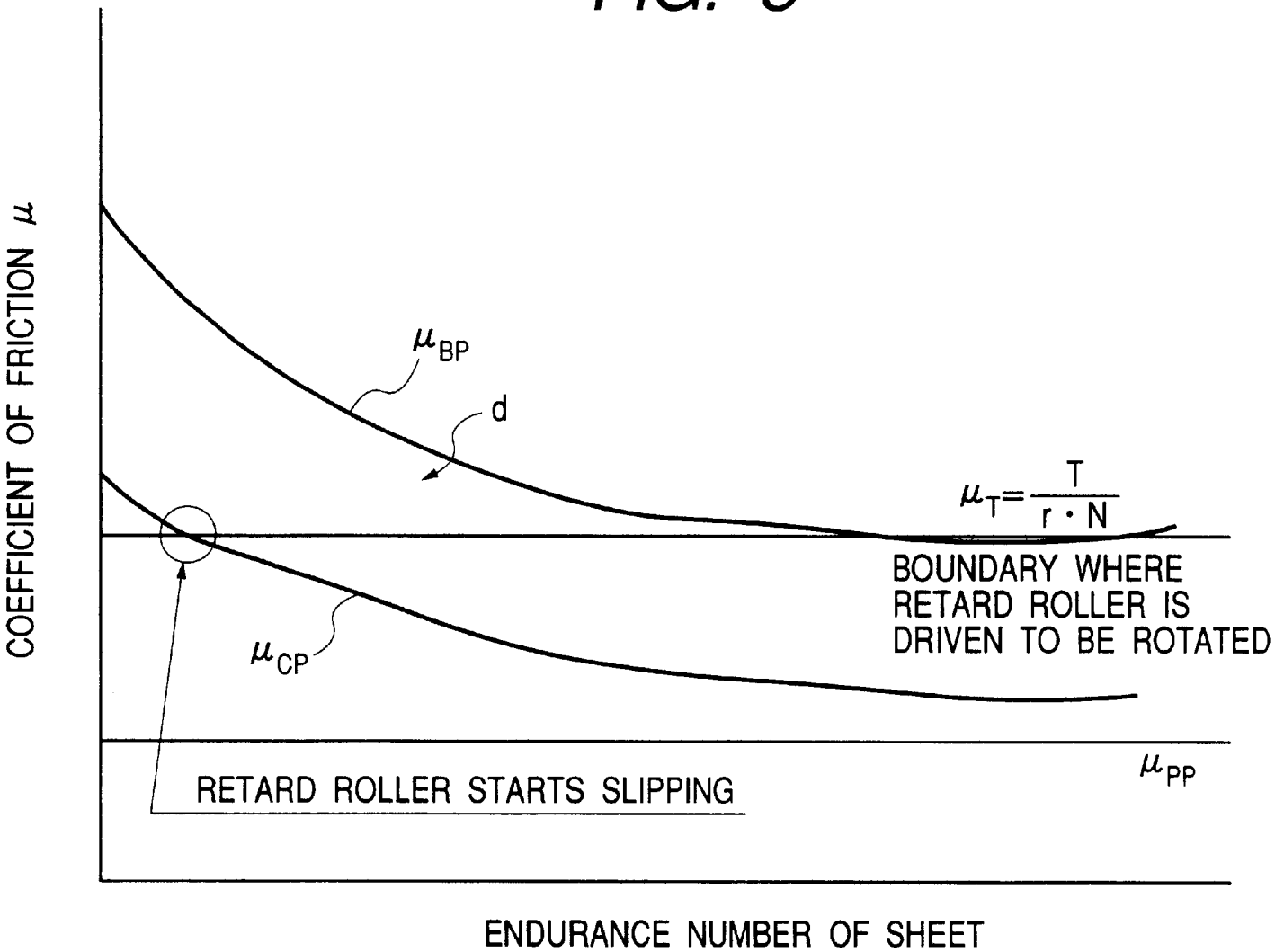
FIG. 3 shows the process of changes in the coefficients of friction of a feed roller and a retard roller.
Figure 12:
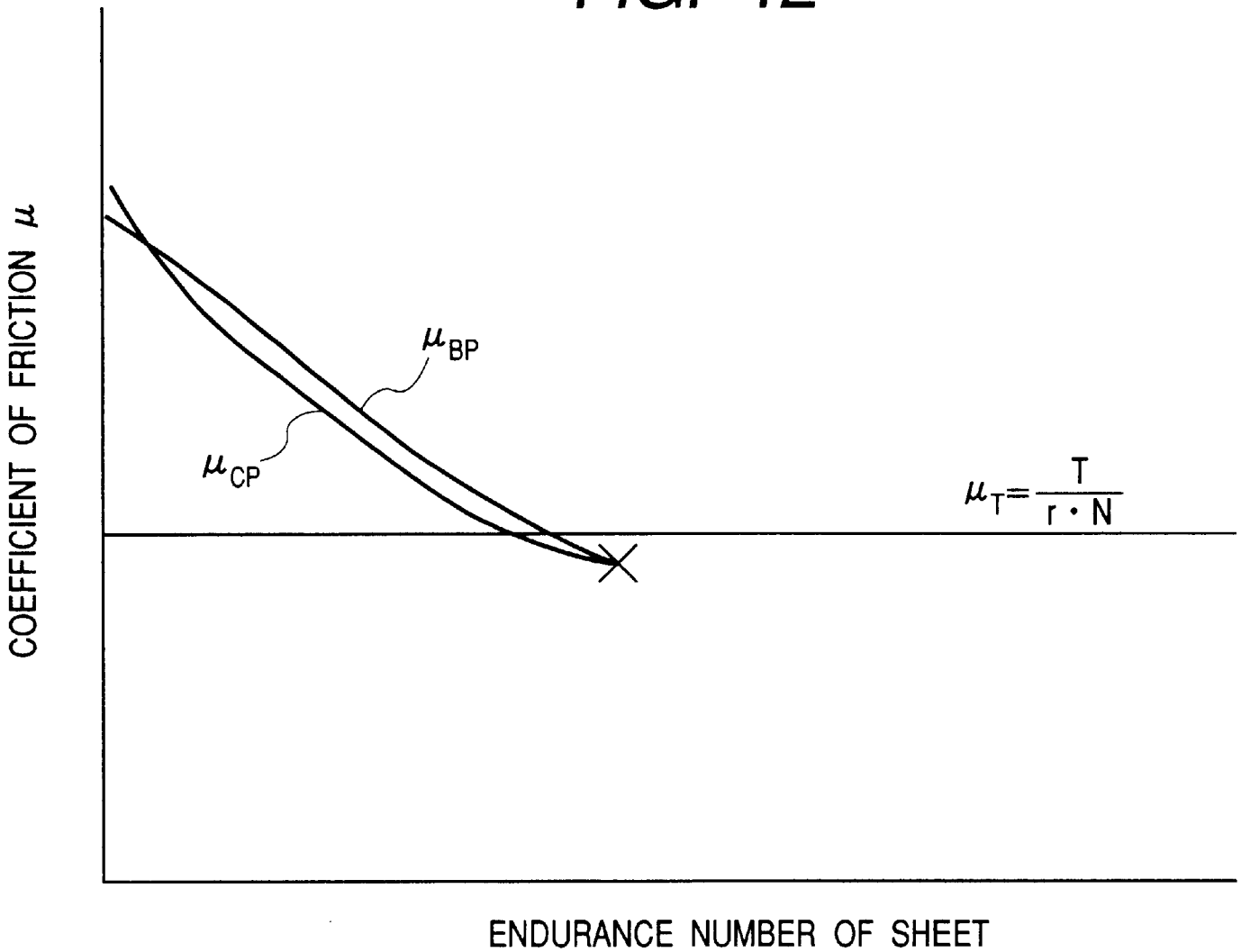
FIG. 12 is a graph showing the process of changes in the coefficients of friction of the feed roller and the retard roller.

On the other hand, FIG. 3 is a graph showing the process of change in $\mu$ (coefficient of friction) during the endurance of the feed roller 6 and the urethane-coated retard roller 7A in the present embodiment, and as shown in this figure, the initial coefficient of friction $\mu_{CP}$ of the retard roller 7A in this embodiment relative to the recording sheet, as compared with the silicon-coated retard roller 7 according to the prior art already described and shown in FIG. 12, is greatly smaller than the coefficient of friction $\mu_{BP}$ between the feed roller 6 and the recording sheet, and may progress while maintaining such relative even if the endurance progresses.

Description will now be made of theoretical expressions satisfying the feeding and separating conditions for the recording sheets in the sheet feeding apparatus 1 according to the present embodiment.

Here, when the coefficient of friction between the feed roller 6 and the retard roller 7A is defined as $\mu_{BC}$ and the coefficient of friction between the feed roller 6 and the recording sheet is defined as $\mu_{BP}$ and the coefficient of friction between the retard roller 7A and the recording sheet is defined as $\mu_{CP}$ and the coefficient of friction between the sheets is defined as $\mu_{PP}$ and the pressurizing force of the retard roller 7A is defined as N and the idling torque of a torque limiter 20 is defined as T and the effective radius of the retard roller 7A is defined as r and the returning force of the torque limiter 20 is defined as T/r, in the present embodiment, the coefficient of friction of the retard roller 7A is set so that the feeding condition, the conveying condition and the slipping and separating condition of the retard roller 7A may be as follows:

| | | |
|---|---|---|
| feeding condition | $\mu_{BC}N > T/r$ | (7) |
| conveying condition | $\mu_{BP} > \mu_{CP}$ | (8) |
| slipping and separating condition of retard roller 7A | $T/r > \mu_{CP}N > \mu_{PP}N$ | (9) |

Also, when T/r·N is $\mu_T$, expressions (7) to (9) become as follows:

| | | |
|---|---|---|
| feeding condition | $\mu_{BC} > \mu_T$ | (10) |
| conveying condition | $\mu_{BP} > \mu_{CP}$ | (11) |
| slipping and separating condition of retard roller 7A | $\mu_T > \mu_{CP} > \mu_{PP}$ | (12) |

FIG. 3 will now be described in detail by the use of these expressions (10) to (12).

In FIG. 3, the area indicated by arrow d is a state in which the sheets are conveyed under the same feeding and separating conditions as in the aforedescribed example of the prior art. When the endurance progresses and the coefficient of friction $\mu_{CP}$ between the retard roller 7A and the recording sheet lowers and is below the boundary where the retard roller is driven to be rotated, the retard roller 7A comes to slip.

However, when the retard roller 7A thus comes to slip, the conveyance of the recording sheets may be continued because as already described, the coefficient of friction of the retard roller 7A is set so as to satisfy the above-mentioned expressions (7) to (9) or (10) to (12).

That is, as shown in expression (7), $\mu_{BC}$ N>T/r, whereby the frictional force between the retard roller 7A and the feed roller 6 can overcome the returning force of the torque limiter 20, whereby the torque limiter 20 can be idly rotated and the retard roller 7A can be rotated in the conveying direction with the feed roller 6.

Also, as shown in expression (8), $\mu_{BP}>\mu_{CP}$, whereby the recording sheet can be conveyed by the feed roller 6 even if the retard roller 7A slips relative to the recording sheet being conveyed.

Also, as shown in expression (9), T/r>$\mu_{CP}$ N>$\mu_{PP}$ N, whereby the retard roller 7A can slip relative to the recording sheet being conveyed and can separate the recording sheet.

In the present embodiment, design is made such that in the initial state, T/r<$\mu_{CP}$ N and that as the endurance progresses, a change to T/r>$\mu_{CP}$ N>$\mu_{PP}$ N occurs. Thereby, in the initial state, the retard roller 7A is rotated in the recording sheet conveying direction during the conveyance of the recording sheets, but comes to slip relative to the recording sheets due to the returning force of the torque limiter as the endurance progresses.

Now, in the case of the urethane-coated retard roller 7A in the present embodiment, it has been confirmed that there are the following two patterns in which the roller 7A meets the end of its life.

Pattern 1 is a case where it has become impossible to satisfy expression (10), that is, a case where the coefficient of friction $\mu_{BC}$ between the feed roller 6 and the retard roller 7A has become small and before the recording sheet cuts in between the feed roller 6 and the retard roller 7A, the driven rotation of the two rollers becomes null and the recording sheet cannot cut in between the rollers from the beginning.

Also, pattern 2 is a case where it has become impossible to satisfy expression (11), that is, a case where the coefficient of friction $\mu_{BP}$ between the feed roller 6 and the recording sheet becomes smaller than the coefficient of friction $\mu_{CP}$ between the retard roller 7A and the recording sheet, whereby the recording sheet can cut in between the feed roller 6 and the retard roller 7A, but the feed roller 6 is bindered by the retard roller 7A and cannot convey the recording sheet.

In the case of pattern 1, a state in which the leading end of the recording sheet cutting in between the two rollers is bent by the retard roller 7A rotated in the returning direction (so-called matchwood folding jam) occurs frequently, and in the case of pattern 2, the recording sheet comes to jam while remaining sandwiched between the feed roller 6 and the retard roller 7A (delayed feed jam or the like).

However, by setting the coefficient of friction of the retard roller 7A so as to satisfy the above-mentioned expressions (7) to (9) or (10) to (12), even if $\mu_{CP}$ which has been regarded as the endurance life in the example of the prior art comes to be below $\mu_T$ determined by the feeding condition, and the retard roller 7A slips relative to the recording sheet being conveyed, the conveying condition is still effective and it does not happen that the retard roller comes to the end of its life.

Also, under such a condition in which the retard roller 7A is slipping relative to the recording sheet being conveyed, the damage given to the feed roller 6 by the recording sheet becomes small, and this also leads to the effect that the feed roller 6 can be continued to rotate while keeping its coefficient of friction high.

Figure 4:
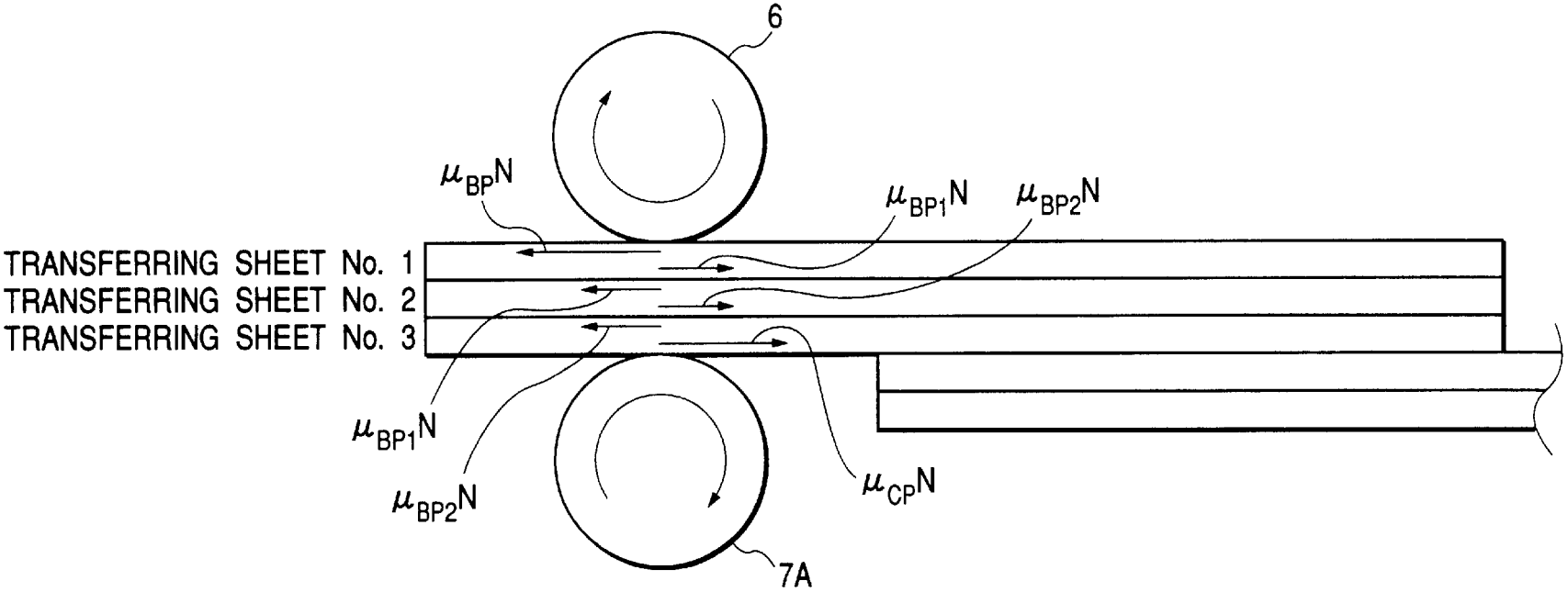
FIG. 4 illustrates the bundle conveying state of the sheet feeding apparatus.

A state in which a plurality of recording sheets are separated under such a condition will hereinafter be described with reference to FIG. 4. FIG. 4 typically shows the state when bundle-conveyed recording sheets are separated between the feed roller 6 and the retard roller 7A.

As previously described, in the present embodiment, the conveying force $\mu_{BP}$ N the recording sheet receives from the feed roller 6 is greater than the conveying force $\mu_{CP}$ N the recording sheet receives from the retard roller 7A and therefore, even when shift has been made to under such a condition that the retard roller 7A slips relative to the recording sheet being conveyed and is reversely rotated, the recording sheets can be sufficiently conveyed, and the damage to the feed roller 6 becomes small and the durability of the feed roller is greatly improved.

Figure 10:
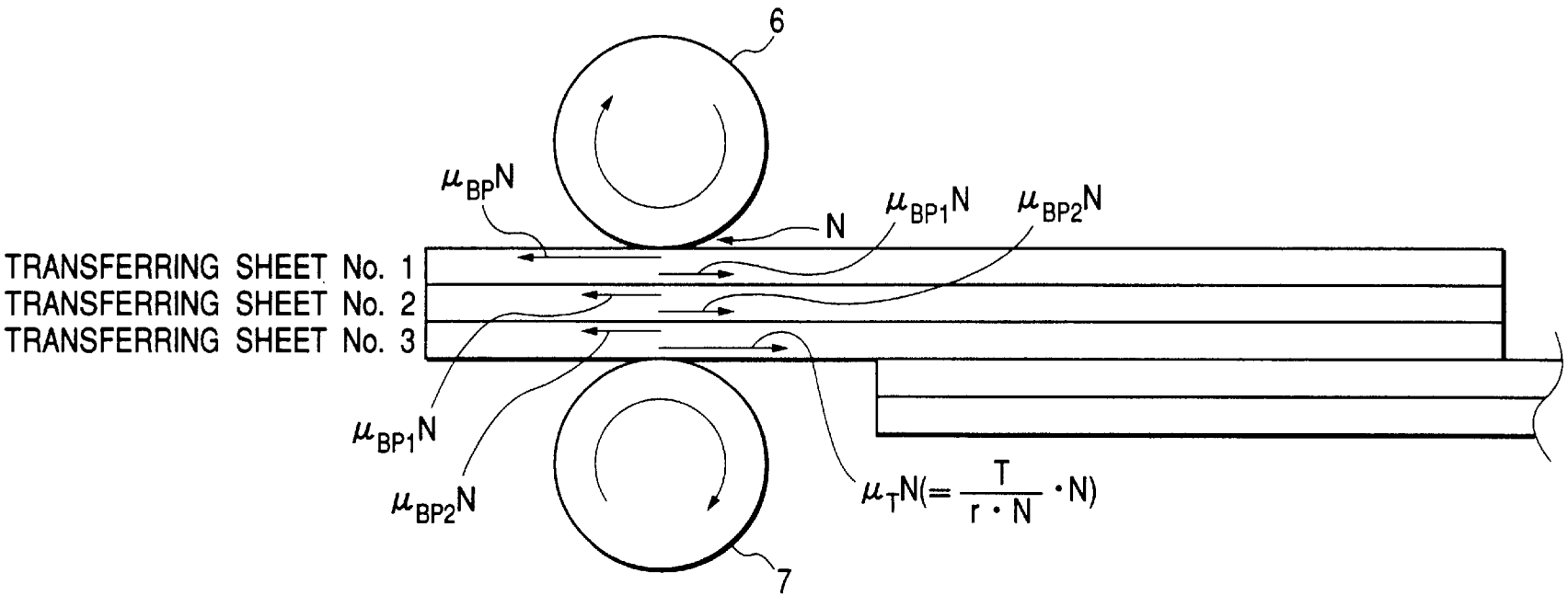
FIG. 10 is a typical view for illustrating the state of bundle conveyance in the sheet feeding apparatus.
Figure 11:
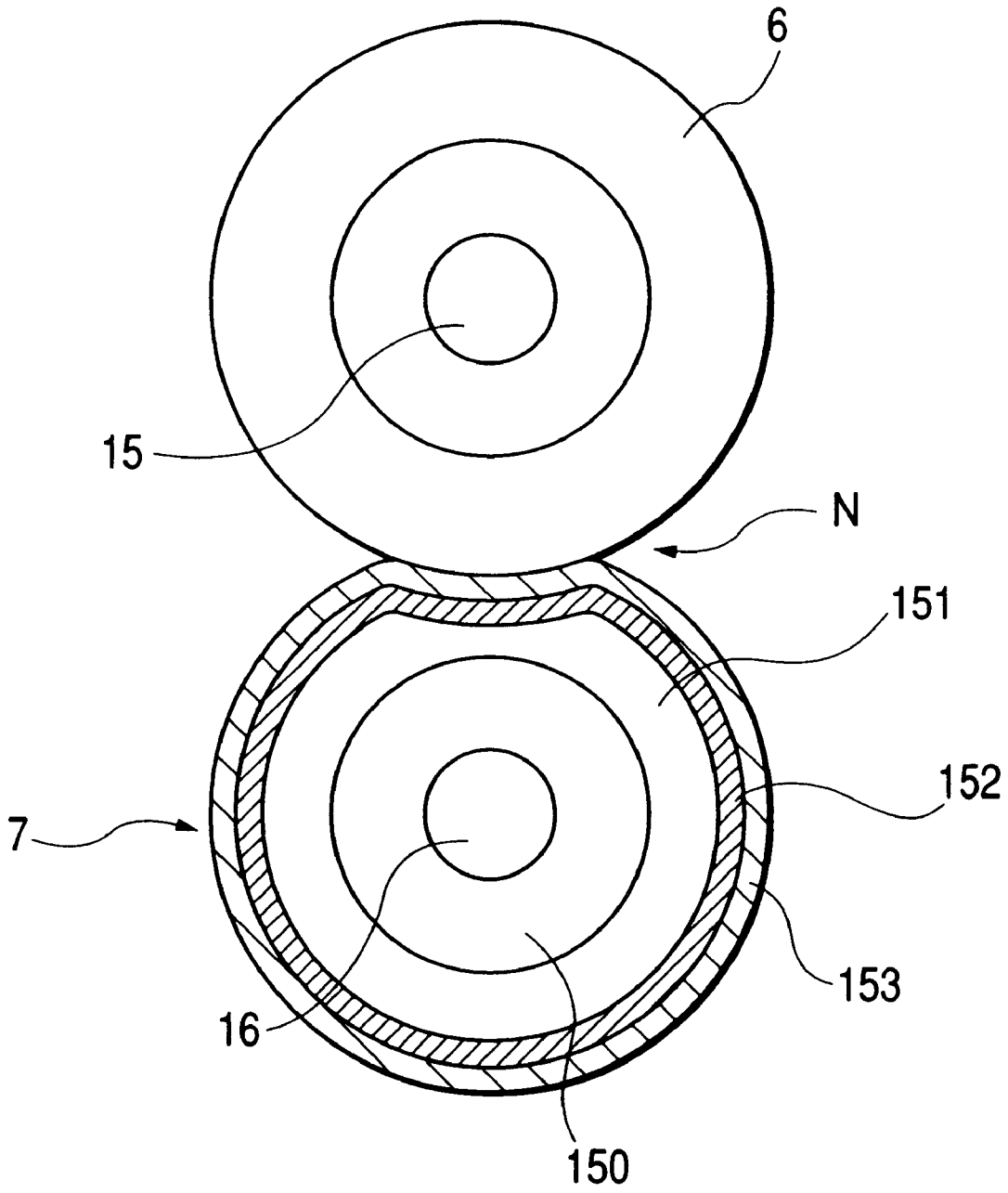
FIG. 11 illustrates the structure of the feed roller and the retard roller.

Also, in the present embodiment, as shown in expression (12) already described, $\mu_{CP}$ is above the coefficient of friction $\mu_{PP}$ between the sheets and therefore, even in such a case that a plurality of recording sheets cut in the form of a bundle, the recording sheets can be separated without any problem. The mechanism of this separation can be said to be just the same as the mechanism of separation in the prior art shown in FIG. 10 already described, with the exception that in the example of the prior art, the force working for separation is T/r, whereas in the present embodiment, it is $\mu_{CP}$ N, and therefore need not be described in detail here.

By constructing so, when particular paper containing a great deal of calcium carbonate therein is to be conveyed, even a case where both of $\mu_{BP}$ and $\mu_{PC}$ have been severely reduced for a small number of passed sheets under the influence of paper powder produced during the conveyance does not become a cause of a short life.

As an example of the present embodiment, the initial $\mu$ for the particular recording paper containing a great deal of calcium carbonate therein was a little over 2.0 for the feed roller 6 and was of the order of 1.0 for the retard roller 7A, whereby for initial 10,000 to 20,000 sheets, shift was made to the slip phenomenon of the retard roller 7A, whereafter the recording sheets were conveyed while the above-mentioned expressions (10) to (12) were maintained, whereby a double or longer endurance life was realized while separation stability equal to that of the prior-art silicon-coated retard roller was secured under the same feeding condition (T and N being the same) as that of the silicon-coated retard roller.

As described above, by setting the coefficient of friction of the retard roller 7A so as to satisfy the above-mentioned expressions (7) to (9) or (10) to (12), the recording sheets can be sufficiently conveyed even in such a state in which the feeding and separating conditions cannot be satisfied by the prior-art silicon-coated retard roller, that is, in a case where shift has been made to under such a condition that the retard roller 7A slips relative to the recording sheet being conveyed and is reversely rotated.

Also, the damage to the feed roller 6 becomes small and the durability of the feed roller is greatly improved. Further, the retard roller 7A in the present embodiment does not use the silicon material which is costly and is therefore low in cost as compared with the prior-art silicon-coated retard roller.

While in the foregoing description, a case where the sponge retard roller 7A is used as constituting the separating and feeding means with the feed roller 6 has been described, the present invention is not restricted thereto, but as the separating rotary member, a belt-shaped member having elasticity may be used instead of the roller.

Figure 5:
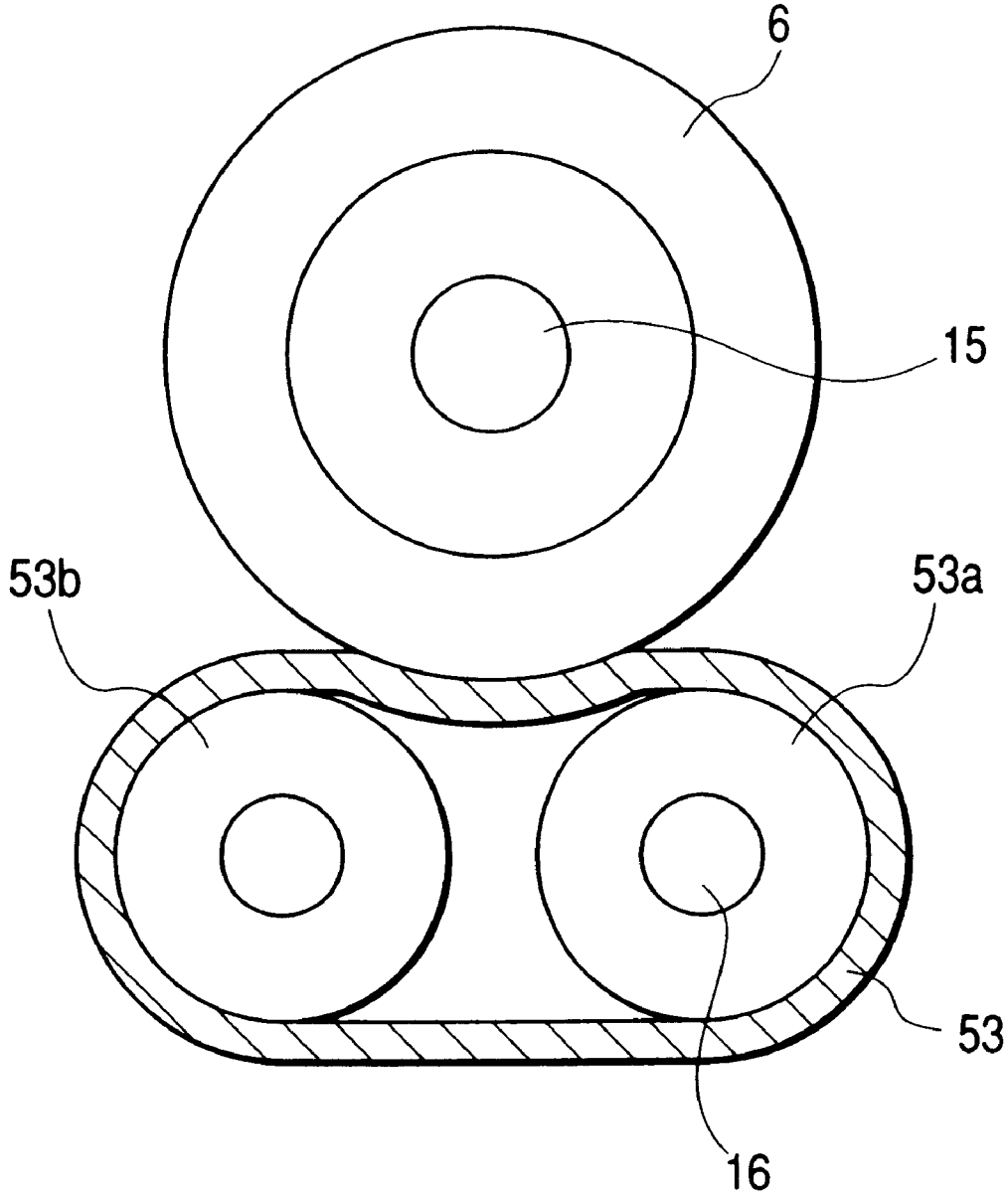
FIG. 5 illustrates the structure of the feed roller and elastic retard belt of a sheet feeding apparatus according to a second embodiment of the present invention.
Figure 6:
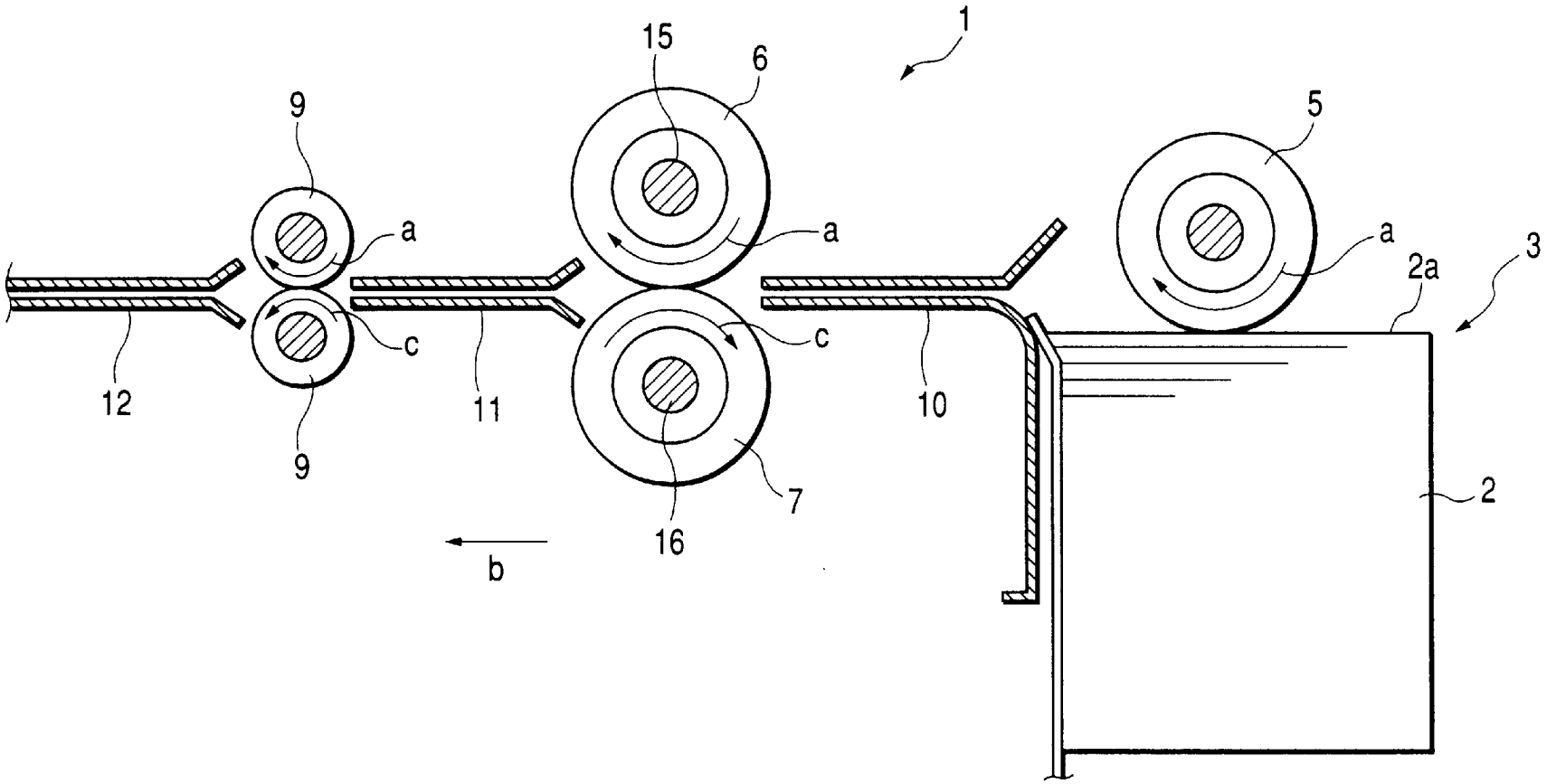
FIG. 6 shows the construction of a sheet feeding apparatus according to the prior art.
Figure 7:
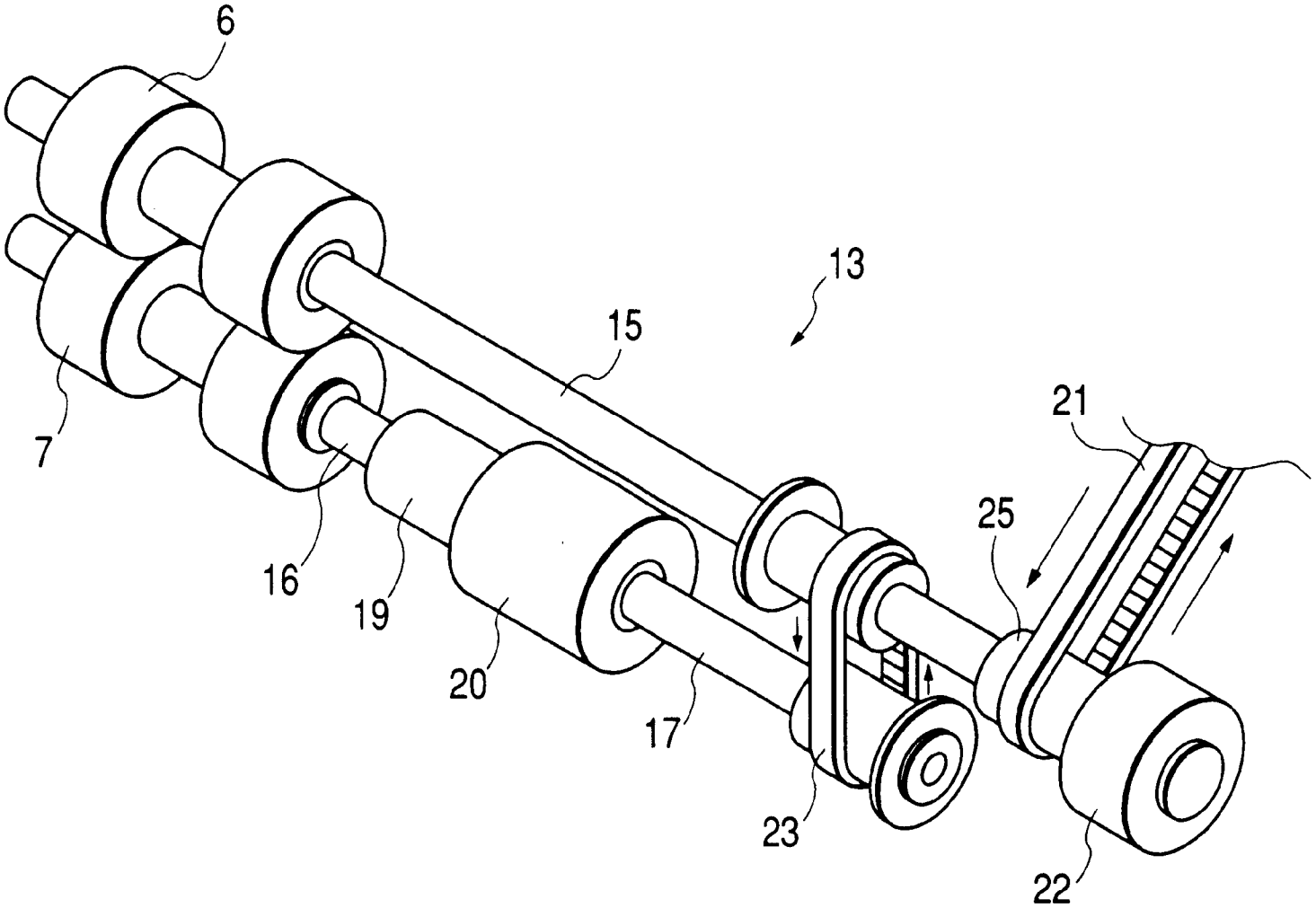
FIG. 7 is a perspective view of essential portions showing the constructions of the feed roller of the sheet feeding apparatus and a drive transmitting device for driving the retard roller.
Figure 8:
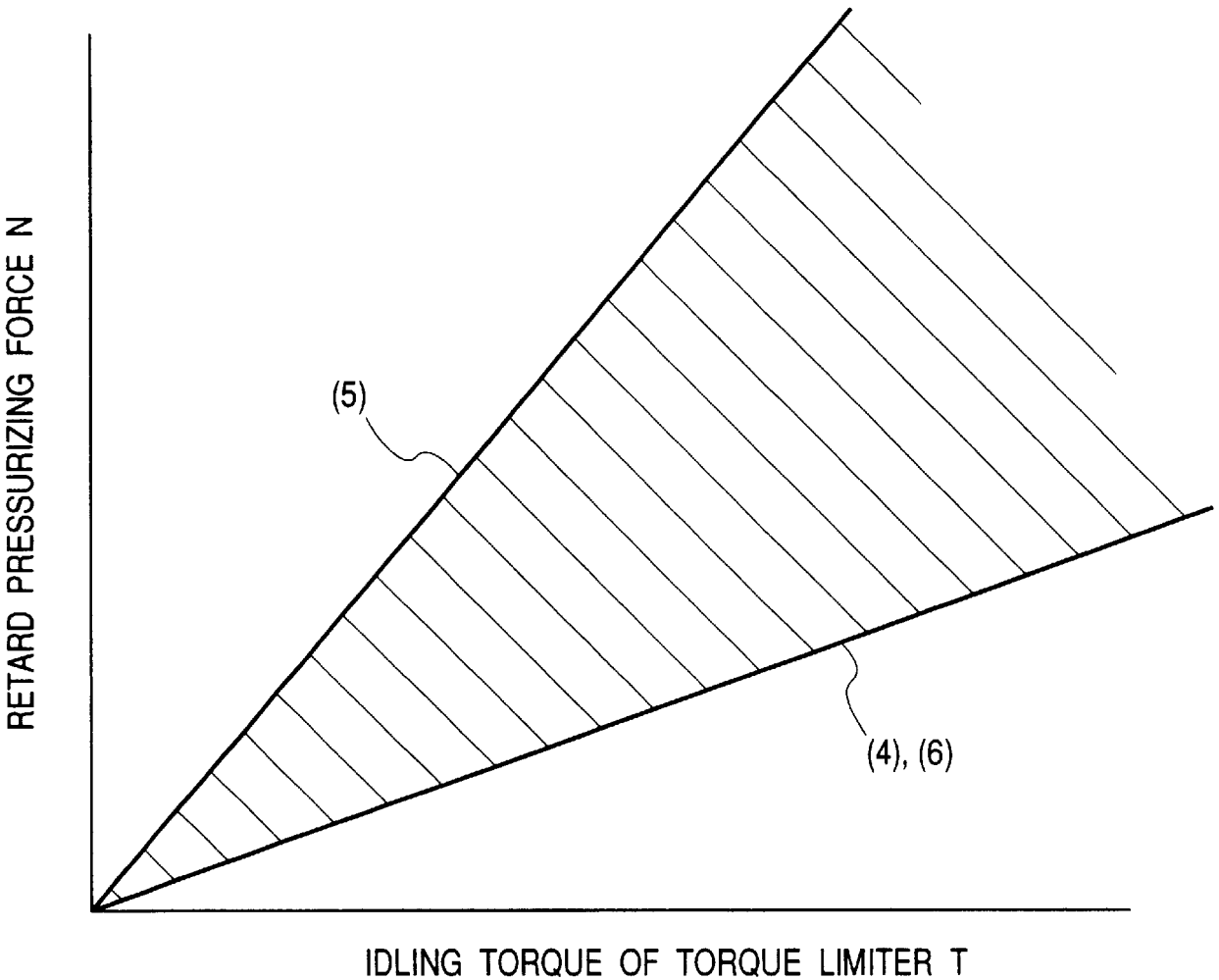
FIG. 8 is a graph showing the relation between the pressurizing force on the retard roller and the idling torque of a torque limiter.
Figure 9:
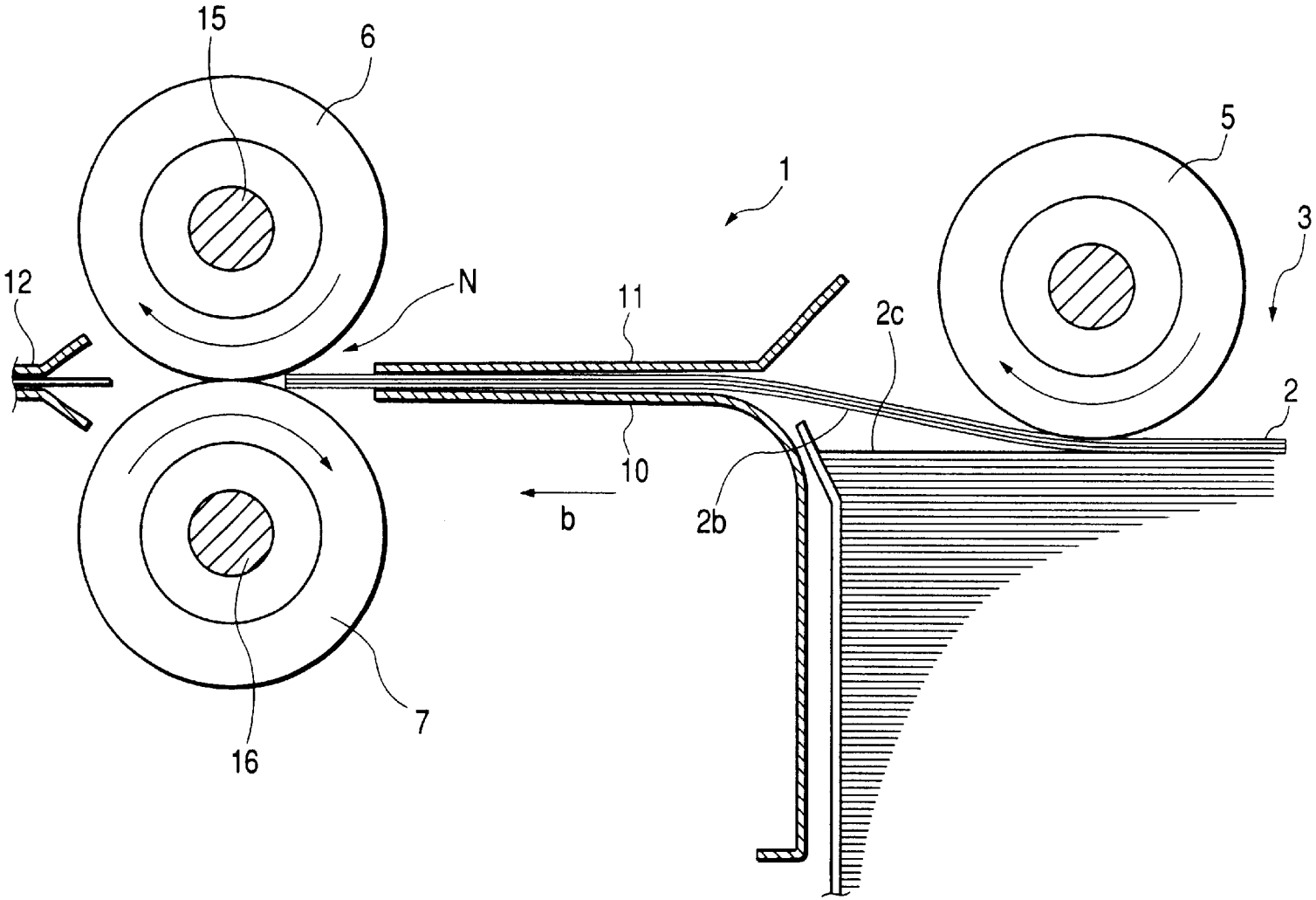
FIG. 9 shows the state of bundle conveyance in the sheet feeding apparatus.

FIG. 5 shows the construction of a sheet feeding apparatus according to such a second embodiment of the present invention, and in FIG. 5, the reference numeral 53 designates an elastic retard belt which is a belt-shaped member having elasticity. Also, the reference characters 53*a* and 53*b* denote driving and driven rollers over which the elastic retard belt 53 is passed, and the driving roller 53*a* is mounted on a retard roller shaft 16.

This elastic retard belt 53 is in pressure contact with the feed roller 6 which is a rubber roller, whereby the pressure contact portion thereof with the feed roller 6 forms a concave shape. By the pressure contact portion with the feed roller 6 being thus formed into a concave shape, recording sheets fed in can be deviated from one another like roofing tiles, whereby bundle-conveyed recording sheets may continue to be reliably gripped during the separating operation, and stable separation becomes possible.

When the elastic retard belt 53 is used as described above, in contrast with the aforedescribed first embodiment wherein a predetermined nip area determined by the hardness and configuration of the sponge retard roller 7A is set, such conditions as the hardness and tension of the belt and the position of the belt relative to the feed roller 6 can be changed to thereby set a predetermined nip area.

Also, in the case of the present embodiment, the elastic retard belt 53 is of a construction in which it is easy to secure a large outer peripheral area relative to the feed roller 6 and therefore, the frequency of the contact between the recording sheet and the elastic retard belt 53 decreases, whereby an improvement in the durability of the elastic retard belt 53 (separating rotary member) can be further expected. In the other points and the surface property (coefficient of friction) of the belt, the present embodiment does not differ from the first embodiment and therefore need not be described in detail.

While the foregoing description has been made of a sheet feeding apparatus provided in an image forming apparatus, the present invention is not restricted thereto, but of course, the present invention can be essentially equally applicable to a sheet feeding apparatus provided in an image reading apparatus and adapted to feed sheets to an image reading portion.

What is claimed is:

1. A sheet feeding apparatus for separating and feeding sheets contained in sheet containing means one by one, comprising:

separating and feeding means for separating and feeding the sheets one by one, said separating and feeding means including a feeding rotary member rotatable in a direction to feed said sheets, and a separating rotary member brought into pressure contact with said feeding rotary member and rotatable in a direction to return the sheets to said sheet containing means; and a torque limiter provided between said separating rotary member and a driving shaft for driving said separating rotary member, for transmitting the drive from said driving shaft to said separating rotary member and idly rotated when predetermined rotational torque in a reverse direction is transmitted to said separating rotary member;

wherein a coefficient of friction of said separating rotary member is set so that relations that $$\mu_{BC}\,N>T/r$$

$$\mu_{BP}>\mu_{CP}$$

$$T/r>\mu_{CP}\,N>\mu_{PP}\,N$$

may be established among a coefficient of friction $\mu_{BC}$ between said feeding rotary member and said separating rotary member, a coefficient of friction $\mu_{BP}$ between said feeding rotary member and the sheet, a coefficient of friction $\mu_{CP}$ between said separating rotary member and the sheet, a coefficient of friction $\mu_{PP}$ between the sheets, a pressure contact force N of said separating rotary member, an idling torque T of said torque limiter and an effective radius r of said separating rotary member.

2. A sheet feeding apparatus according to claim 1, wherein said separating rotary member has such a coefficient of friction that a relation among the coefficient of friction $\mu_{CP}$ between said separating rotary member and the sheet, the coefficient of friction $\mu_{PP}$ between said sheets, the idling torque T of said torque limiter and the effective radius r of said separating rotary member is $T/r<\mu_{CP}\,N$ in an initial state thereof, and changes to said $T/r>\mu_{CP}\,N>\mu_{PP}\,N$ as an endurance of said separating rotary member progresses.

3. A sheet feeding apparatus according to claim 1, wherein said feeding rotary member is a rubber roller, and said separating rotary member is a sponge roller softer than said feeding rotary member.

4. A sheet feeding apparatus according to claim 3, wherein said sponge roller has a sponge base material disposed inside, and a coating layer provided on an outer peripheral side of said sponge base material and formed of a material of the same origin as said sponge base material.

5. A sheet feeding apparatus according to claim 4, wherein said sponge base material and said coating layer are urethane materials of the same quality.

6. A sheet feeding apparatus according to claim 3, wherein the pressure contact portion between said feeding rotary member and said separating rotary member is of a concave shape.

7. A sheet feeding apparatus according to claim 1, wherein said feeding rotary member is a rubber roller, and said separating rotary member is a belt-shaped member having elasticity and of which the pressure contact portion with said rubber roller is of a concave shape.

8. A sheet feeding apparatus according to claim 1, further comprising sheet feeding means for feeding out the sheets from said sheet containing means, wherein the sheets fed out by said sheet feeding means are separated one by one by said separating and feeding means.

9. An image forming apparatus having a sheet feeding apparatus for separating and feeding sheets contained in sheet containing means one by one, and an image forming portion for forming images on the sheets fed out by said sheet feeding apparatus, said image forming apparatus comprising:

separating and feeding means for separating and feeding the sheets one by one, said separating and feeding means including a feeding rotary member rotatable in a direction to feed said sheets, and a separating rotary member brought into pressure contact with said feeding rotary member and rotatable in a direction to return the sheets to said sheet containing means; and a torque limiter provided between said separating rotary member and a driving shaft for driving said separating rotary member, for transmitting the drive from said driving shaft to said separating rotary member, and idly rotated when predetermined rotational torque in a reverse direction is transmitted to said separating rotary member;

wherein a coefficient of friction of said separating rotary member is set so that relations that $$\mu_{BC}\,N>T/r$$

$$\mu_{BP}>\mu_{CP}$$

$$T/r>\mu_{CP}\,N>\mu_{PP}\,N$$

may be established among a coefficient of friction $\mu_{BC}$ between said feeding rotary member and said separating rotary member, a coefficient of friction $\mu_{BP}$ between said feeding rotary member and the sheet, a coefficient of friction $\mu_{CP}$ between said separating rotary member and the sheet, a coefficient of friction $\mu_{PP}$ between the sheets, a pressure contact force N of said separating rotary member, an idling torque T of said torque limiter and an effective radius r of said separating rotary member.

10. An image reading apparatus provided with a sheet feeding apparatus for separating and feeding sheets contained in sheet containing means one by one, and a reading portion for reading images on the sheets fed out by said sheet feeding apparatus, said image reading apparatus comprising:

separating and feeding means for separating and feeding the sheets one by one, said separating and feeding means including a feeding rotary member rotatable in a direction to feed said sheets, and a separating rotary member brought into pressure contact with said feeding rotary member and rotatable in a direction to return the sheets to said sheet containing means; and a torque limiter provided between said separating rotary member and a driving shaft for driving said separating rotary member, for transmitting the drive from said driving shaft to said separating rotary member, and idly rotated when predetermined rotational torque in a reverse direction is transmitted to said separating rotary member;

wherein a coefficient of friction of said separating rotary member is set so that relations that $$\mu_{BC}\,N>T/r$$

$$\mu_{BP}>\mu_{CP}$$

$$T/r>\mu_{CP}\,N>\mu_{PP}\,N$$

may be established among a coefficient of friction $\mu_{BC}$ between said feeding rotary member and said separating rotary member, a coefficient of friction $\mu_{BP}$ between said feeding rotary member and the sheet, a coefficient of friction $\mu_{CP}$ between said separating rotary member and the sheet, a coefficient of friction $\mu_{PP}$ between the sheets, a pressure contact force N of said separating rotary member, an idling torque T of said torque limiter and an effective radius r of said separating rotary member.

* * * * *

UNITED STATES PATENT AND TRADEMARK OFFICE

CERTIFICATE OF CORRECTION

PATENT NO. : 6,520,497 B2 
DATED : February 18, 2003
INVENTOR(S) : Masashige Tamura It is certified that error appears in the above-identified patent and that said Letters Patent is hereby corrected as shown below:

Column 2,
Line 22, “a” should read -- and --.

Column 4,
Line 35, “that” should read -- when --.

Column 5,
Line 11, “the” should read -- a --.
Line 37, “$\mu_{BP}\mu_{CP}$.” should read -- $\mu_{BP} \approx \mu_{CP}$. --.

Column 8,
Line 18, “eating” should read -- feeding --.

Signed and Sealed this

Seventh Day of October, 2003

JAMES E. ROGAN
*Director of the United States Patent and Trademark Office*